US008858261B2

(12) United States Patent
Bäuerle

(10) Patent No.: US 8,858,261 B2
(45) Date of Patent: Oct. 14, 2014

(54) DEVICE FOR ELECTRICALLY CONNECTING A CABLE, IN PARTICULAR A PLUG-IN CONNECTOR PART HAVING A SHIELDED CONTACT ELEMENT

(75) Inventor: Gottfried Bäuerle, Follbach (DE)

(73) Assignee: Pfisterer Kontaktsysteme GmbH, Winterbach (DE)

( * ) Notice: Subject to any disclaimer, the term of this patent is extended or adjusted under 35 U.S.C. 154(b) by 0 days.

(21) Appl. No.: 13/261,452

(22) PCT Filed: Apr. 13, 2011

(86) PCT No.: PCT/EP2011/001839

§ 371 (c)(1), (2), (4) Date: Oct. 3, 2012

(87) PCT Pub. No.: WO2011/128076

PCT Pub. Date: Oct. 20, 2011

(65) Prior Publication Data

US 2013/0029525 A1 Jan. 31, 2013

(30) Foreign Application Priority Data

Apr. 14, 2010 (DE) ..... 10 2010 014 982

(51) Int. Cl.

*H01R 13/648* (2006.01)
*H01R 9/05* (2006.01)
*H01R 101/00* (2006.01)

(52) U.S. Cl.

CPC ..... *H01R 9/0518* (2013.01); *H01R 2101/00* (2013.01); *H01R 9/0527* (2013.01)

USPC ..... 439/607.41; 439/98

(58) Field of Classification Search

USPC ..... 439/607.41, 98, 95, 96

See application file for complete search history.

(56) References Cited

U.S. PATENT DOCUMENTS

| | | | | |
|---|---|---|---|---|
| 5,429,529 | A | 7/1995 | Hashizawa | |
| 7,204,716 | B1 * | 4/2007 | George et al. | 439/607.41 |
| 7,597,563 | B2 * | 10/2009 | Shinkawa et al. | 439/98 |
| 2009/0035993 | A1 * | 2/2009 | Okayasu | 439/610 |

FOREIGN PATENT DOCUMENTS

| | | | |
|---|---|---|---|
| DE | 296 07 803 | U1 | 7/1996 |
| DE | 200 04 019 | U1 | 6/2001 |
| DE | 696 18 428 | T2 | 8/2002 |
| DE | 10 2005 033 910 | A2 | 3/2006 |
| DE | 10 2007 038 168 | A1 | 3/2008 |
| EP | 1 587 165 | A1 | 10/2005 |
| WO | WO 2007/101435 | A1 | 9/2007 |

* cited by examiner

*Primary Examiner* — Gary Paumen

(74) *Attorney, Agent, or Firm* — Roylance, Abrams, Berdo and Goodman LLP

(57) ABSTRACT

A device (11) for electrically connecting a cable, in particular a plug-in connector part (2), has a housing (148) in which a shielding element (159) is arranged for electrically contacting a cable shield (157) and for electrically connecting the cable shield (157) to the housing (148). The shielding element (159) is multipart. A first part (131) of the shielding element (159) is in electrically connecting abutment against the housing (148), and can be electroconductively connected to the cable shield (157) by at least one further part (135, 137) of the shielding element (159).

23 Claims, 14 Drawing Sheets

DEVICE FOR ELECTRICALLY CONNECTING A CABLE, IN PARTICULAR A PLUG-IN CONNECTOR PART HAVING A SHIELDED CONTACT ELEMENT

FIELD OF THE INVENTION

The invention relates to a device for electrically connecting a cable, in particular a plug-in connector part having a shielded contact element.

BACKGROUND OF THE INVENTION

Typically, in electrical plug-in connectors, a plug element and a socket element are mated, the contact elements of the plug element and of the socket element come into electrical contact with one another, and the electrical current is carried via the contact surfaces produced in this way. In electrical prime movers or in automotive engineering, for example, with a generic device, a power supply line or a cable is connected to a motor or generating set, with the device being mounted on the line end or cable end.

To the extent that a cable with a cable shield is used for the power supply line, it is recommended or necessary to clamp the cable shield to a definable potential, for example, to ground potential. For this purpose, a shielded contact element is used, hereinafter also referred to as a shielding element for short.

SUMMARY OF THE INVENTION

An object of the invention is to provide an improved device for electrically connecting a cable, in particular a plug-in connector part, with which stable, reliable electrical contact-making with the cable shield is ensured. In one embodiment, high contact stability and relatively high current carrying capacity are to be ensured, in particular, by the contact-making of the shield being designed to be insensitive to mechanical and/or thermal loads.

This object is basically achieved by a device having a housing in which a shielding element makes electrical contact with a cable shield and electrically connects the cable shield to the housing. The shielding element has several parts. A first part of the shielding element is in electrically connecting contact with the housing part and can be connected in an electrically conductive manner to the cable shield via at least one other part of the shielding element. Because the shielding element includes of several parts, the individual parts can be matched to the required properties. For example, the first part of the shielding element can be optimized with respect to electrical contact-making and connection to the housing. In this way, stable, reliable contact-making is ensured.

Furthermore, because the shielding element has several parts, making electrical contact with the cable shield is ensured even when strong vibrations or forces occur. The other parts of the shielding element can be optimized for this purpose. Moreover, with high contact stability due to the several parts, a definable distance between the contact-making with the cable shield and the main contact of the device can be implemented.

In one embodiment, the first part of the shielding element is substantially sleeve-shaped and can be deformed elastically in the peripheral direction. For this purpose, the first part can, for example, have a slot extending in the axial direction, preferably a continuous slot. In this way, the first part can be elastically deformed in the peripheral direction with comparatively low forces. Reliable contact, especially of the outer side of the first part, with the housing is ensured. In the undeformed state, the first part on the outer side can be conical, and the cone angle can be between 0.5° and 10°, especially between 0.8° and 5°, and preferably between 1° and 3°. The first part can be elastically deformable upon insertion into a housing with a cylindrical or conical cavity.

Advantageous, contact of the first part of the shielding element which makes contact is ensured by a resilient deflection. The deflection is oblique and in particular transverse to the occurrence of tensile forces on the cable, as typically occur during vibrations or in a vibration test. In this way, the first part is not loaded in the direction of its contact-making deflection when vibrations occur, so that the shielding contact makes available an especially high vibration strength.

In one embodiment, the first part on its outer side has at least one contact which can be kept in electrically connecting contact with the housing by the elastic deformation of the first part. The elastic deformation or the active reset force makes available the contact force. In one embodiment, the first part has several, especially three, contacts arranged preferably uniformly distributed in the peripheral direction. The contacts can be made in one piece from the first part. The contacts can be formed by embossing or molding of the first part.

In one embodiment, the first part on its inner side has at least one other contact which can be kept in electrically connecting contact with another part of the shielding element. The first part can have several, especially three, other contacts arranged preferably uniformly distributed in the peripheral direction. The other contacts can be made in one piece from the first part. The other contacts can be formed by embossing or molding of the first part.

In one embodiment, the contacts on the outer side and the other contacts on the inner side are located in pairs along a line parallel to the longitudinal axis of the shielding element, especially of the first part of the shielding element. In this way, the shield current in the first part flows in a straight line and/or parallel to the cable. The other contacts can form a stop for the axial movement of the first part relative to another part of the shielding element. The portion of the first part having the further contacts can be bent to the inside relative to the bordering or adjacent portion, with the angle being more than 0.2° and less than 6°, especially more than 0.5° and less than 4°, and preferably more than 0.5° and less than 2.5°. This structure ensures reliable contact-making with the other part of the shielding element and/or prevents mainly bending stress of the portion with the other contacts in the case of pivoting of the first part. The first part can have structure for avoiding or reducing eddy currents, for example, longitudinal slots extending preferably parallel to the longitudinal axis of the first part or of the shielding element.

In one embodiment, the shielding element has a second part connecting the first part to the cable shield in an electrically conductive manner. The second part has a sleeve-shaped portion with which the second parts can be crimped onto the cable shield. The second part forms a bridge from the radially inside cable to the radially outside housing. In this case, the second part can also transfer a force in the axial direction with which the main contact of the device is kept in contact with the housing.

In one embodiment, the second part with one edge portion is in electrically connecting contact with the first part. The edge portion can project with a radial direction component from a longitudinal axis of the second part, in particular can project transversely to the longitudinal axis. The edge portion can be in contact with one inner side of the sleeve-shaped portion of the first part. In this way, reliable contact-making is ensured. The edge portion can form a stop for an axial and/or radial movement between the first and second parts, especially by the interaction with the other contacts of the first part.

In one embodiment, the shielding element has a third part having at least one first sleeve-shaped portion with whose inner side the insulation of the cable with the cable shield located thereon can be surrounded by the third part. The third part can be fixed especially by clamping on the cable, in particular the cable shield and/or the cable jacket. This arrangement ensures reliable mechanical attachment of the third part.

In one embodiment, the second part of the shielding element can be applied to the outer side of the first sleeve-shaped portion of the third part with interposition of the cable shield folded down around the free end of the first sleeve-shaped portion. Electrical contact can thus be made with the cable shield. The first sleeve-shaped portion forms the counterhold for applying the second part and thus ensures reliable electrical contact-making with the cable shield.

In one embodiment, the third part has a second sleeve-shaped portion with which a jacket of the cable can be surrounded by the third part. The second sleeve-shaped portion can be clamped on the jacket, as a result of which the attachment of the third part to the cable is further improved. The second sleeve-shaped portion has a larger inside diameter than the first sleeve-shaped portion of the third part.

In one embodiment, the shielding element within the housing can transfer a force in the axial direction by which a connecting element which can be connected in a mechanically strong manner to an inner conductor of the cable, and thus the inner conductor of the cable, is immovably fixed in the housing by positive engagement when a tensile force arises. The force is transferred by positive engagement; i.e., the transfer of force is not significantly determined by friction forces. On axially opposing sides, parts of a fixing element are in contact with the shielding element, in particular in contact with the second part of the shielding element. The contact of a first part of the fixing element, for example, an insulating sleeve, with the shielding element, for example, with the second part, can be radially different from the contact of a second part of the fixing element, for example, of a sealing sleeve, with the shielding element. In particular, the contact of the first part of the fixing element can lie radially farther to the inside than the contact of the second part of the fixing element.

In one embodiment, the plug-in connector parts are designed for electrical voltages in the range of more than 12 V and less than 2400 V, especially more than 24 V and less than 1000 V, and preferably up to an operating voltage of 700 V. In one embodiment, the plug-in connector parts are used in automotive engineering, in particular for electric or hybrid vehicles, or for electric prime movers.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure.

DETAILED DESCRIPTION OF THE INVENTION

Figure 1:
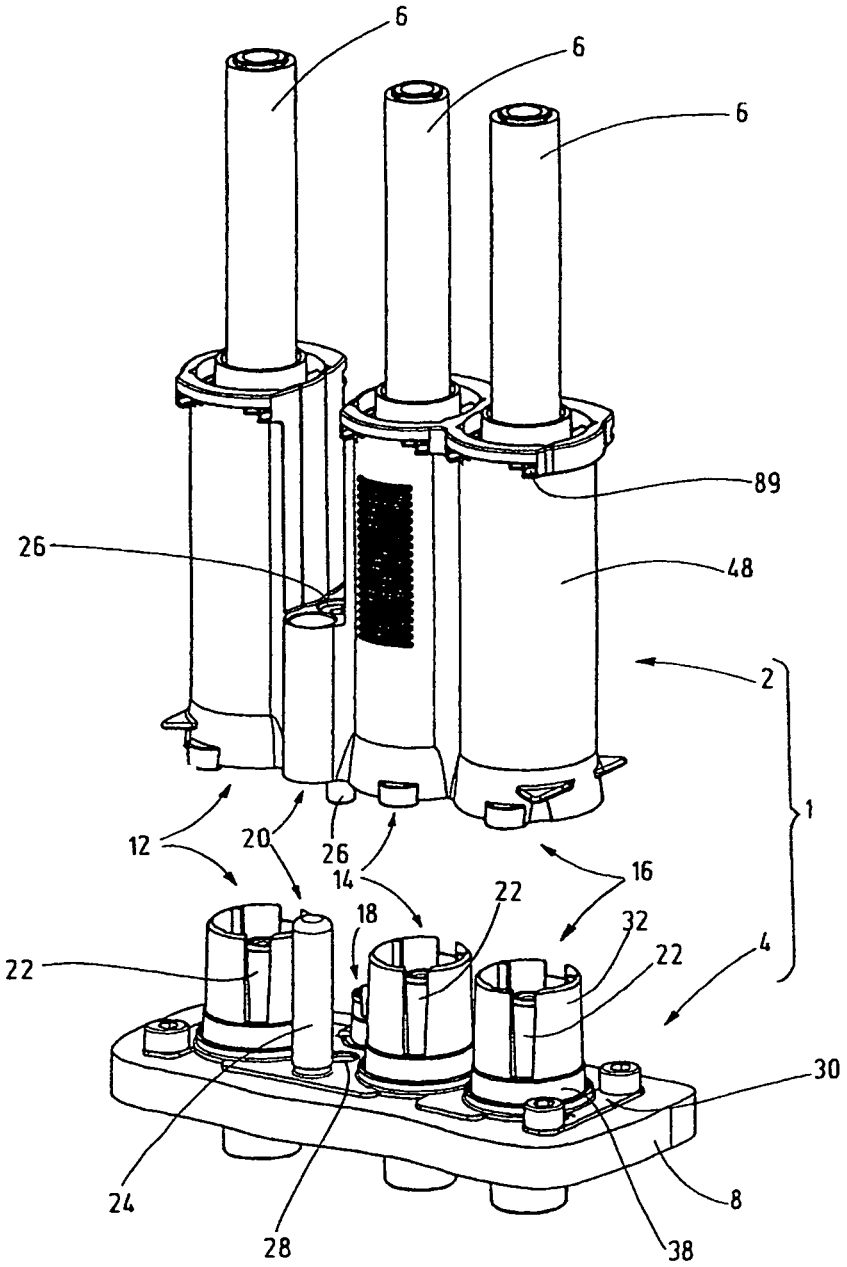
FIG. 1 is a perspective view of a plug-in connector system according to a first exemplary embodiment of the invention.

FIG. 1 shows a perspective view of a first exemplary embodiment of a plug-in connector system 1 having a first plug-in connector part 2 and a second plug-in connector part 4 in the as-yet unmated state. The first plug-in connector part 2 is designed as a three-pole plug with which three single-pole electrical lines 6, each made as a cable with a cable jacket, can be electrically connected to the second plug-in connector part 4. A housing 48 contains, for example, the sleeve-shaped contact elements shown in FIGS. 17 and 18 and brought into electrical contact with preferably cylindrical contact pins 22 in the second plug-in connector part 4 when the first and second plug-in connector parts 2, 4 are mated.

The second plug-in connector part 4 in the exemplary embodiment is located on a housing wall 8 of a generating set, for example, on a generator or on an electric motor. The first and second plug-in connector parts 2, 4 each have three load contacts 12, 14, 16 used for electrically connecting the electrical lines 6, and one pilot contact 18. In FIG. 1, only the pertinent pilot contact of the second plug-in connector part 4 is partially visible.

The two plug-in connector parts 2, 4 moreover have components 20 for guiding the first plug-in connector part 2 when mated with the second plug-in connector part 4. On the sides of the second plug-in connector part 4, pin 24 serves as a guide component, is cylindrical at least in sections and is tapered on its end facing the first plug-in connector part 2 that is especially rounded and/or has a conical surface.

Between the components 20 for guidance and the pilot contact 18, the two plug-in connector parts 2, 4 have components for interlocking the first plug-in connector part 2 on the second plug-in connector part 4. In the exemplary embodiment, the side of the first plug-in connector part 2 has a connecting screw 26. Sides of the second plug-in connector part 4 have a threaded hole 28. The second plug-in connector part 4 is preferably detachably mounted by means of a terminal strip 30 on the housing wall 8. In the exemplary embodiment strip 30 is screwed on.

Figure 2:
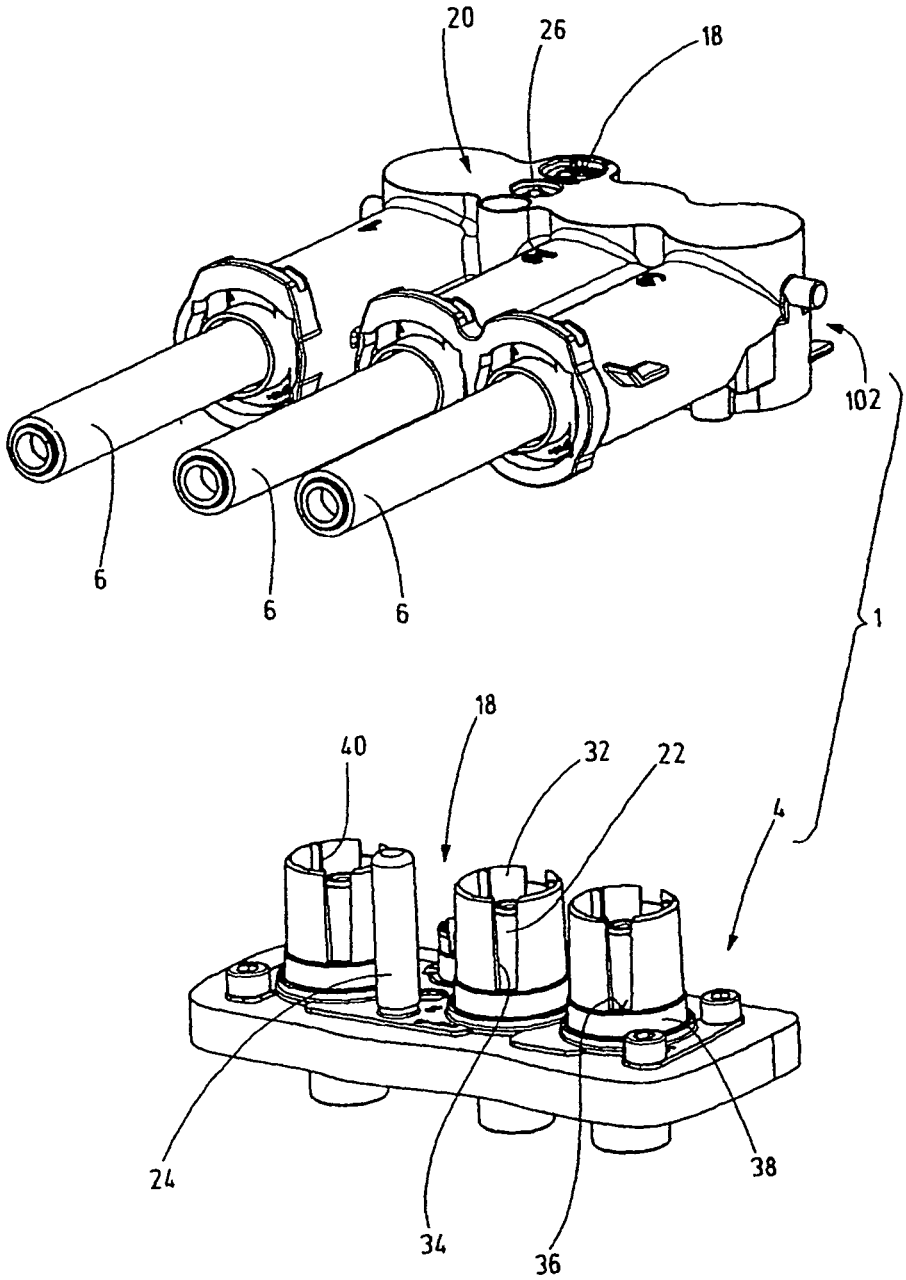
FIG. 2 is a perspective view of a plug-in connector system according to a second exemplary embodiment of the invention.

In the first exemplary embodiment of FIG. 1, the first plug-in connector part 2 has a line guide extending parallel to the plug-in direction. FIG. 2 shows a second exemplary embodiment of a plug-in connector system 1 in which the first plug-in connector part 102 has a line guide of the electrical lines 6 extending angled to the plug-in direction, especially a line guide angled by 90°. The second plug-in connector part 4 is made identically to the second plug-in connector part 4 of the first exemplary embodiment of FIG. 1. In particular, a first plug-in connector part 2 with a line guide extends parallel to the plug-in direction, as shown in FIG. 1. A first plug-in connector part 102 with a line guide extending angled to the plug-in direction can be mated to the same second plug-in connector part 4.

Figure 3:
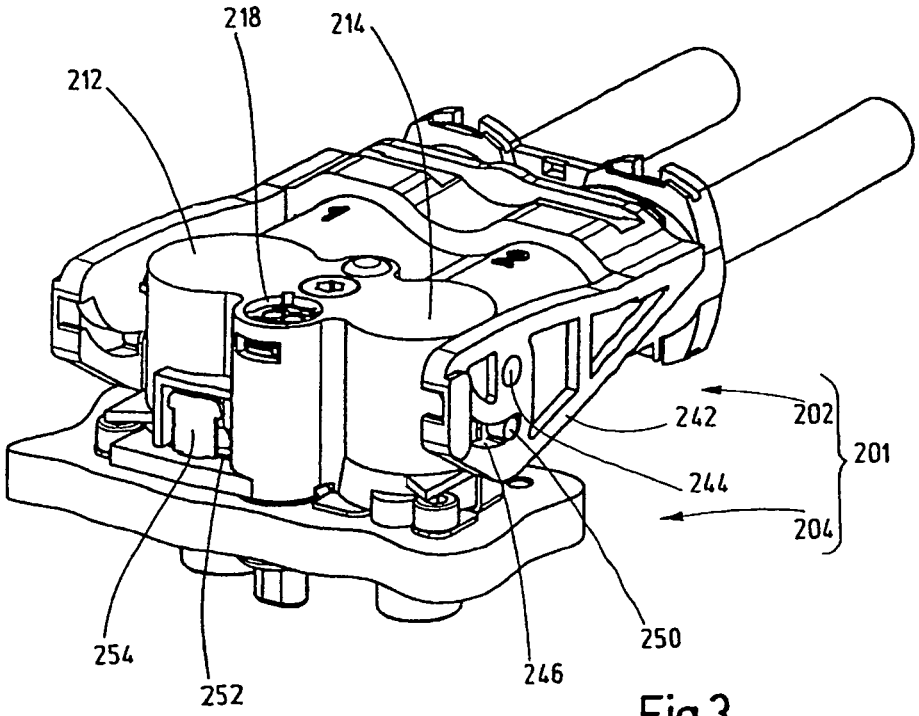
FIG. 3 is a perspective view of a plug-in connector system according to a third exemplary embodiment of the invention.

The components of a first component group with components for the pilot contact 18 and the components for the three load contacts 12, 14, 16 are always independent of a pole number of the first plug-in connector part 102 that is determined by the number of load contacts 12, 14, 16. In particular, the pilot contact 18 is always made identically, regardless of whether it is a one-pole, two-pole, or n-pole plug-in connection. This independence is likewise true of the load contacts 12, 14, 16 in the straight version and the load contacts 212, 214 in the angled version (FIG. 3). The components 20 for guidance during mating and the components 26 for the fixing of the first plug-in connector part 2 on the second plug-in connector part 4 are made independently of the number of poles.

The housing 48 of the first plug-in connector part 2 has a number of receiving chambers for the components of the load contacts 12, 14, 16, which number corresponds to the pole number determined by the number of load contacts 12, 14, 16. The components of the load contacts 12, 14, 16 located within the housing 48 are made identically. The components 20 for guidance during mating and the components of the pilot contact 18 and of the fixing 26 are located between the first load contact 12 located on the left in FIGS. 1 and 2 and the middle load contact 14. In one embodiment, this arrangement is also retained for two-pole or multipole plug-in connections. In particular, the arrangement of the components 20 for guidance of the pilot contact 18 and of the connector 26 is always located between two adjacent load contacts 12, 14, regardless of the number of poles of the plug-in connector system 1.

The second plug-in connector part 4 has a sleeve-shaped portion 32 projecting over the contact pin 22 in the axial direction. Portion 32 can be used for further guidance of the first plug-in connector part 2, 102 when mated to the second plug-in connector part 4. The sleeve-shaped portion 32 has an opening 34 extending in the plug-in direction, being open in the direction of the first plug-in connector part 2, 102 and, in the exemplary embodiment, being formed by a slot. In the mated state, the first plug-in connector part 2, 102 with its housing 48 projects beyond one end 36 of the opening 34, which end faces the second plug-in connector part 4. This is followed by a ring-shaped and preferably cylindrical or conical portion 38 with which in the mated state a seal can be brought into contact and thus seals the contact elements of the plug-in connector system 1. On its inside, the sleeve-shaped portion 32 preferably has a guide 40 made in one piece, extending in the axial direction in the exemplary embodiment and made as crosspieces. By the guide 40 further guidance and/or reverse voltage protection is ensured during mating. In one embodiment, the guide and crosspieces as well as the pertinent recesses can form customer-specific coding of the plug-in connector system 1.

FIG. 3 shows a perspective view of a third exemplary embodiment of a plug-in connector system 201 with a two-pole first plug-in connector part 202 and a two-pole second plug-in connector part 204. The first plug-in connector part 202 is a right angle plug, with the line guide extending at a right angle to the plug-in direction.

Figure 4:
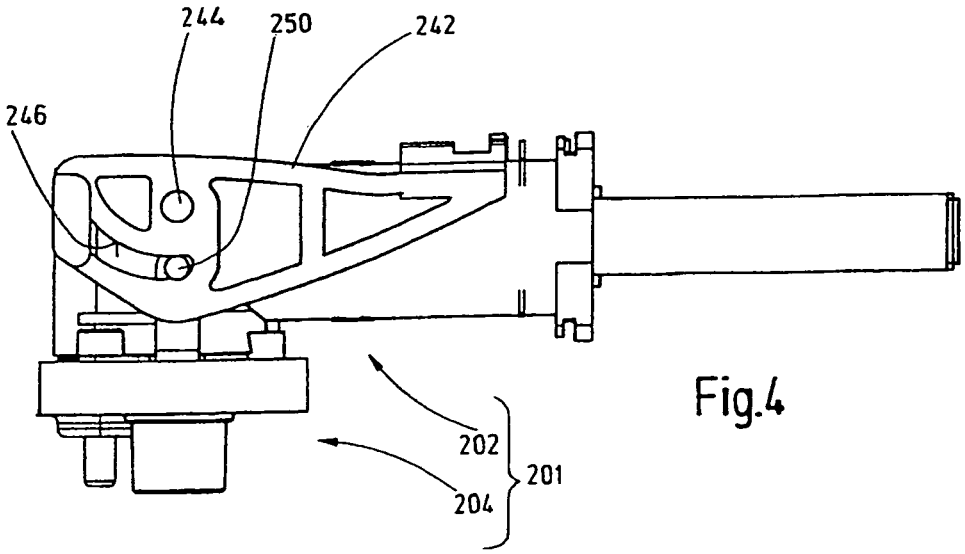
FIG. 4 is a side elevational view of the plug-in connector system of FIG. 3.
Figure 5:
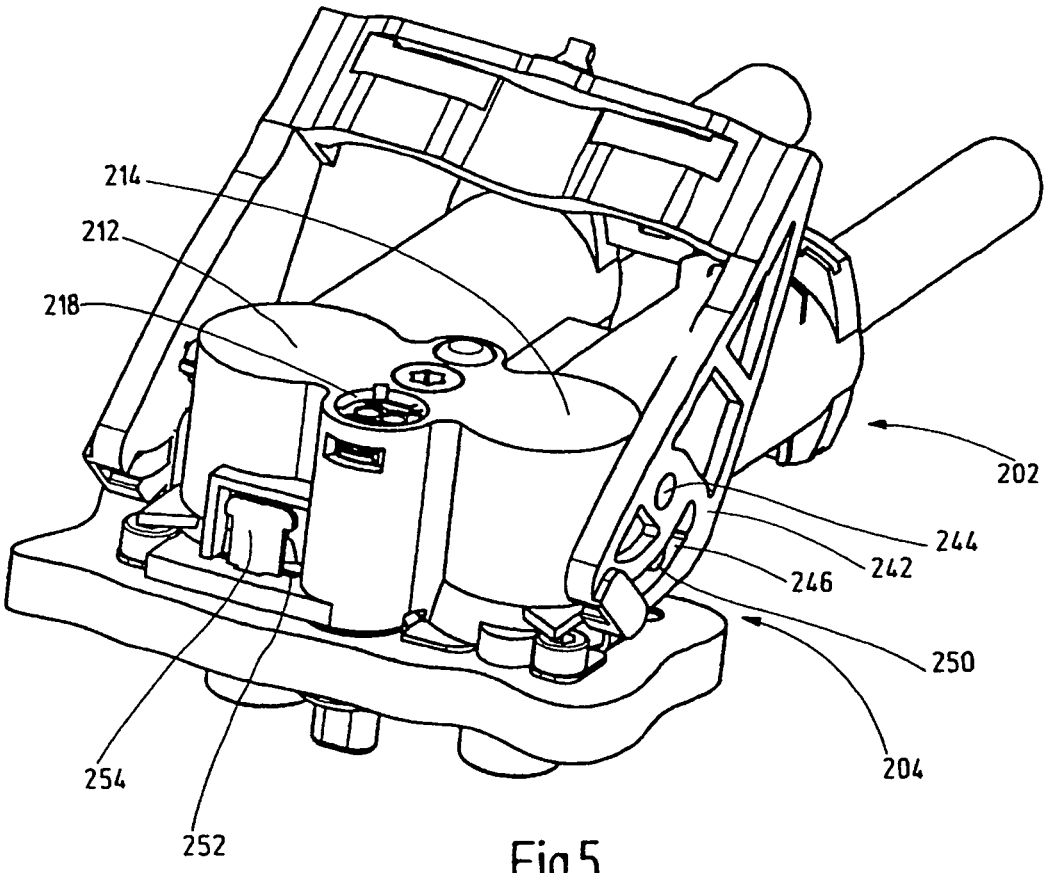
FIG. 5 is a perspective view of the plug-in connector system of FIG. 3 in a partially separated state.

FIG. 4 shows a side view of the plug-in connector system 201 of FIG. 3. FIG. 5 shows a perspective view of the plug-in connector system 201 in a partially separated state in a view which has been enlarged relative to FIGS. 3 and 4.

The first plug-in connector part 202 has a U-shaped actuating element 242 with which the two plug-in connector parts 202, 204 can be transferred out of the completely mated state in FIGS. 3 *and* 4 into a state shown in FIG. 5 in which the pilot contact 218 is either already separated, or, at least, is separated with a complete transfer of the actuating element 242 into a position having been turned or rotated by 90° relative to FIGS. 3 and 4. In this position the load contacts 212, 214 are still electrically connected. The actuating element 242 can be pivoted around an axle journal 244 formed preferably integrally from the first plug-in connector part 202. A radial cam 246 is made in the actuating element 242, for example, by a groove. A guide journal 250 located on the second plug-in connector part 204 is moved along the groove such that the first plug-in connector part 202 rises off the second plug-in connector part 204.

When the actuating element 242 assumes a position rotated by 90° relative to the position in FIG. 3, the pilot contact 218 of the first plug-in connector element 202 is no longer electrically connected to the pilot contact of the second plug-in connector element 204. The load contacts 212, 214 of the first plug-in connector element 202 are still electrically connected to the load contacts of the second plug-in connector element 204.

The actuating element 242 can be detachably locked in its first end position shown in FIGS. 3 and 4 and/or in a second end position rotated by 90°. Due to the lever action of the actuating element 242, both when breaking and when making the connection between the first and the second plug-in connector part 202, 204, only a small actuating force is necessary. This small activating force is especially advantageous at high temperatures and/or under dirty ambient conditions.

The first plug-in connector part 202 and the second plug-in connector part 204 have latches or latching elements 252, 254 corresponding to one another, in the exemplary embodiment. The latch 252 of the first plug-in connector part 202 is formed by a recess in one housing wall and is engaged by the latch 254 of the second plug-in connector part 204 as it is being fitted on and in doing so locks to the opening. For this purpose, the latch 254 of the second plug-in connector part 204 has a starting bevel by which the latch 254 is deflected during mating and snaps back as soon as the latching means 254 engages the opening in the first plug-in connector part 202.

After the first plug-in connector part 202 is transferred out of the position shown in FIGS. 3 *and* 4 into the position shown in FIG. 5 or beyond into a position in which the actuating element 242 has been pivoted by 90°, the latch 254 of the second plug-in connector part 204 is in contact with the edge of the opening of the first plug-in connector part 202, which opening forms the latch 252. This contact prevents complete withdrawal of the first plug-in connector part 202. Only after the latch 254 is disengaged from the latch 252, for example, by a screwdriver or other suitable tool which can be inserted, for example, into the opening and can be subsequently turned, can the first plug-in connector part 202 be completely removed.

In practical applications, there is a time delay of, for example, at least 0.5 to 1 second, because the actuating element 242 must be actuated first. The pilot contact 218 is separated, while the load contacts 212, 214 are still connected. Then, the latches 252, 254 must be disengaged, for example, by a tool, or alternatively also manually without a tool, before the first plug-in connector part 202 can be completely withdrawn. This procedure enables coordinating control of switching of the load contacts 212, 214 at no load, since separation of the pilot contact 218 signals that the connection is to be broken.

In mating, a connection of the load contacts 212, 214 may be established first by clipping on the first plug-in connector part 202. The pilot contact 218 is closed only by the subsequent pivoting of the actuating element 242, whereupon a coordinating control line can energize the load lines. Thus, both the insertion and the breaking of the electrical connection of the load contacts 212, 214 can take place at no load, as a result of which the electrical contacts are protected and a stable, reliable electrical connection can be made available.

Figure 6:
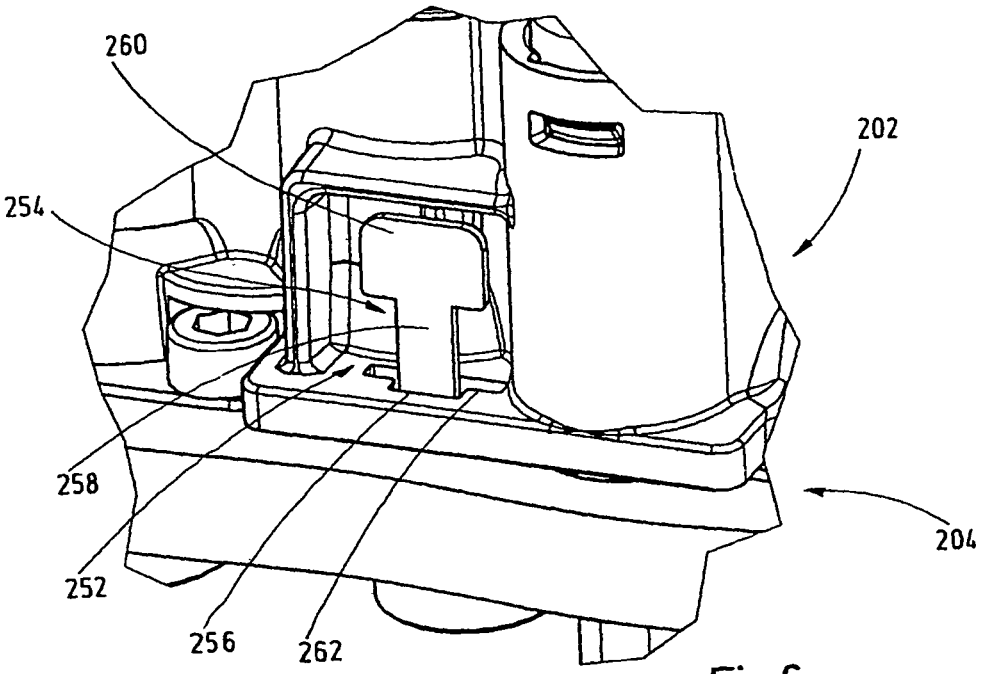
FIG. 6 is a partial perspective view of an enlarged extract in the region of the latch of the plug-in connector system of FIG. 3
Figure 7:
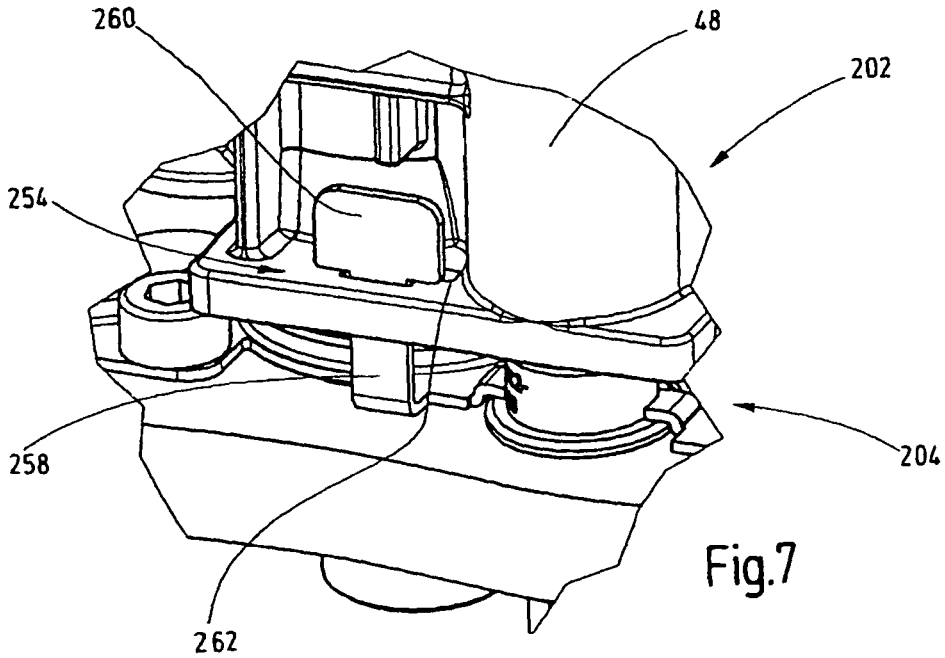
FIG. 7 is an enlarged, partial perspective view of the region of the latching elements of the plug-in connector system of FIG. 3.

FIG. 6 shows in a perspective view an enlarged extract in the region of the latches 252, 254 in a state in which the first plug-in connector part 202 is completely mated to the second plug-in connector part 204 and both the load contacts 212, 214, and the pilot contact 218 are closed. FIG. 7 shows an enlarged extract in the region of the latching elements 252, 254 in a state in which the first plug-in connector part 202 has been detached from the second plug-in connector part 204 to such an extent that the pilot contact 218 is separated, but the load contacts 212, 214 are still connected.

The latching element 252 of the first plug-in connector part has a first opening portion 256 which is slightly larger than a first portion 258 of the second latching element 254, but smaller than a second portion 260 of the second latching element 254. In this way, in the position shown in FIG. 7, the second portion 260 comes into contact with the housing 48 of the first plug-in connector part 2 and stops a complete withdrawal of the first plug-in connector part 202 from the second plug-in connector part 204. Only by deflecting the second latching element 254, for example, by a tool, is the second portion 260 superimposed on a second opening portion 262 of the first latching element 254, which second portion is larger than the first opening portion and is slightly larger than the second portion 260 of the second latching element 254, so that the first plug-in connector part 202 can be removed from the second plug-in connector part 204.

Figure 8:
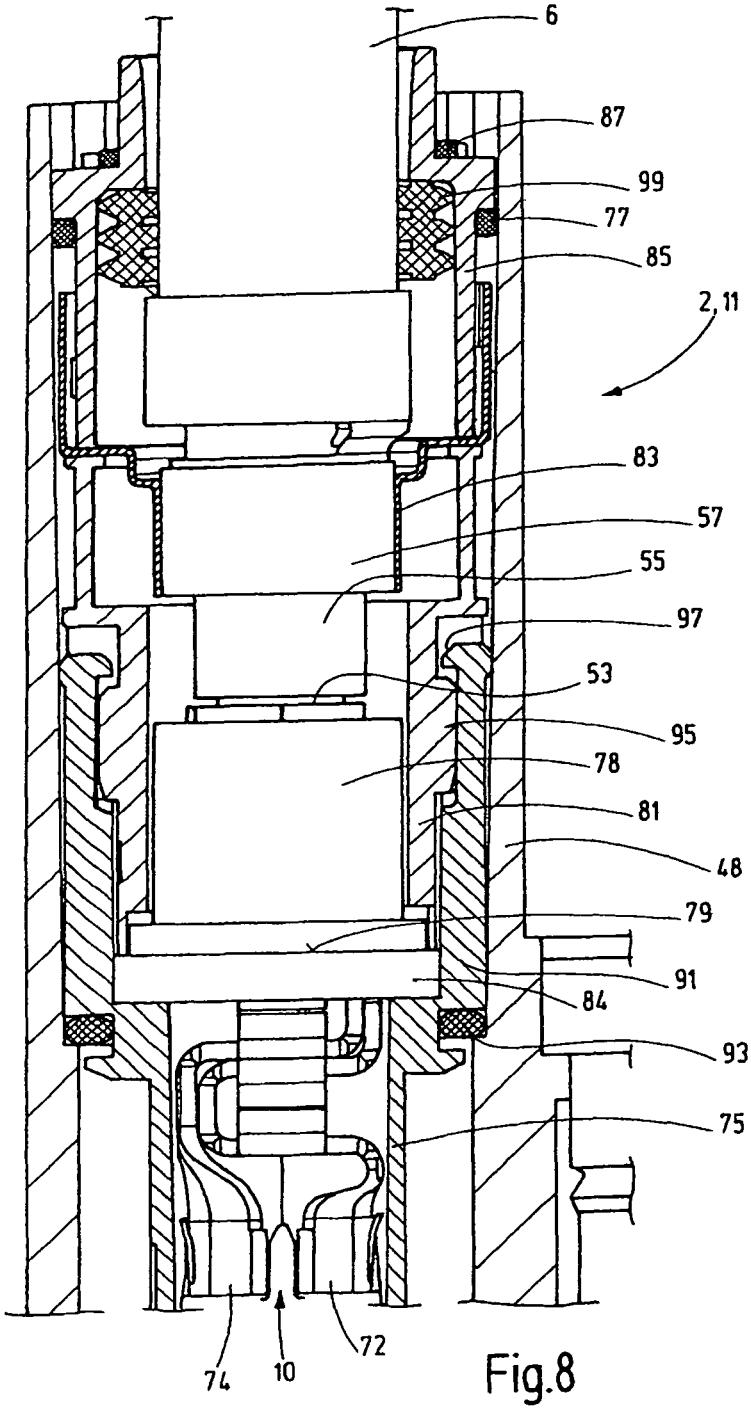
FIG. 8 is a partial front elevational view in section through the housing of the first plug-in connector part of the plug-in connector system of FIG. 1.
Figure 17:
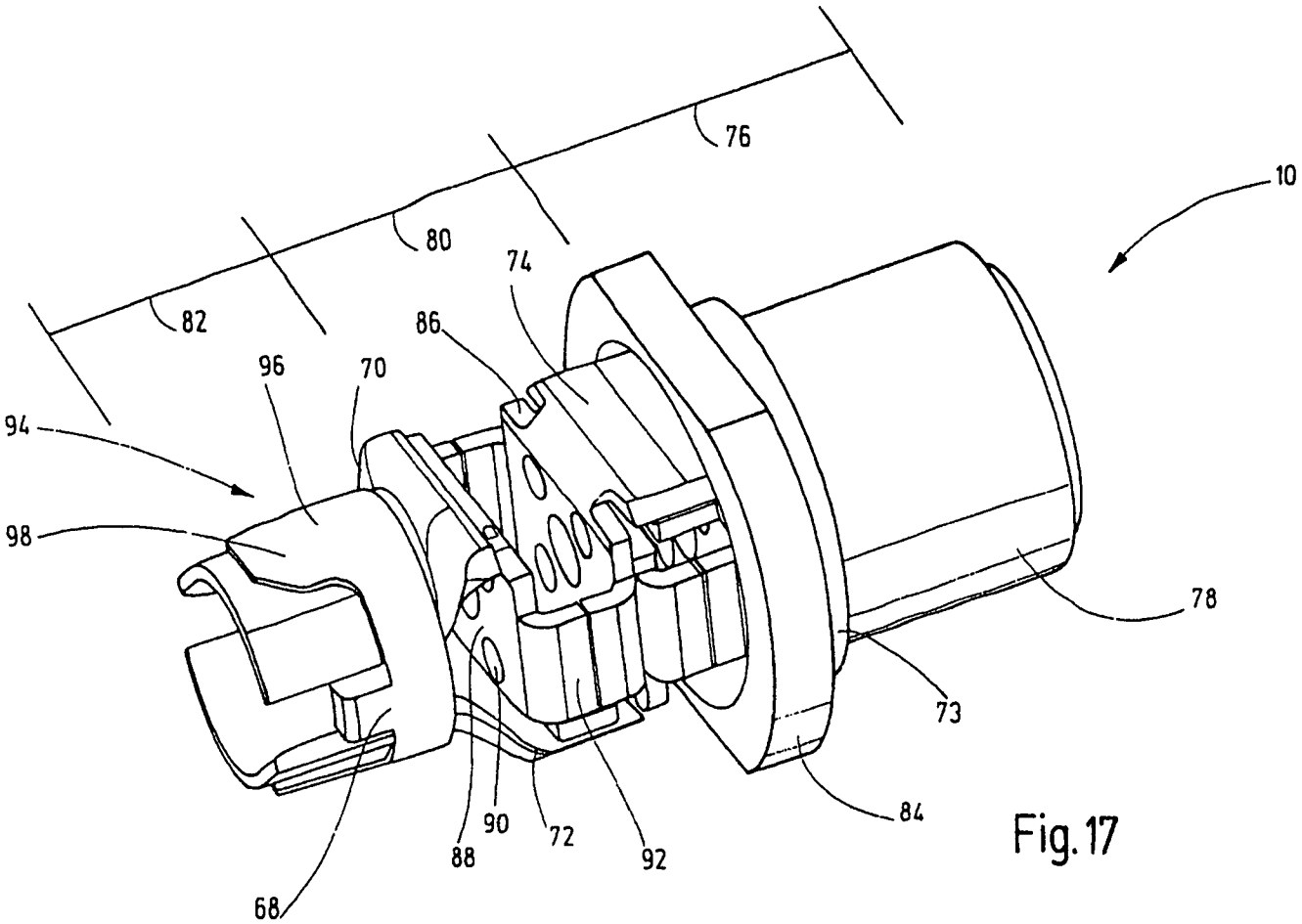
FIG. 17 is a perspective view of a first exemplary embodiment of a plug-in connector element for the plug-in connector system of FIG. 1.
Figure 18:
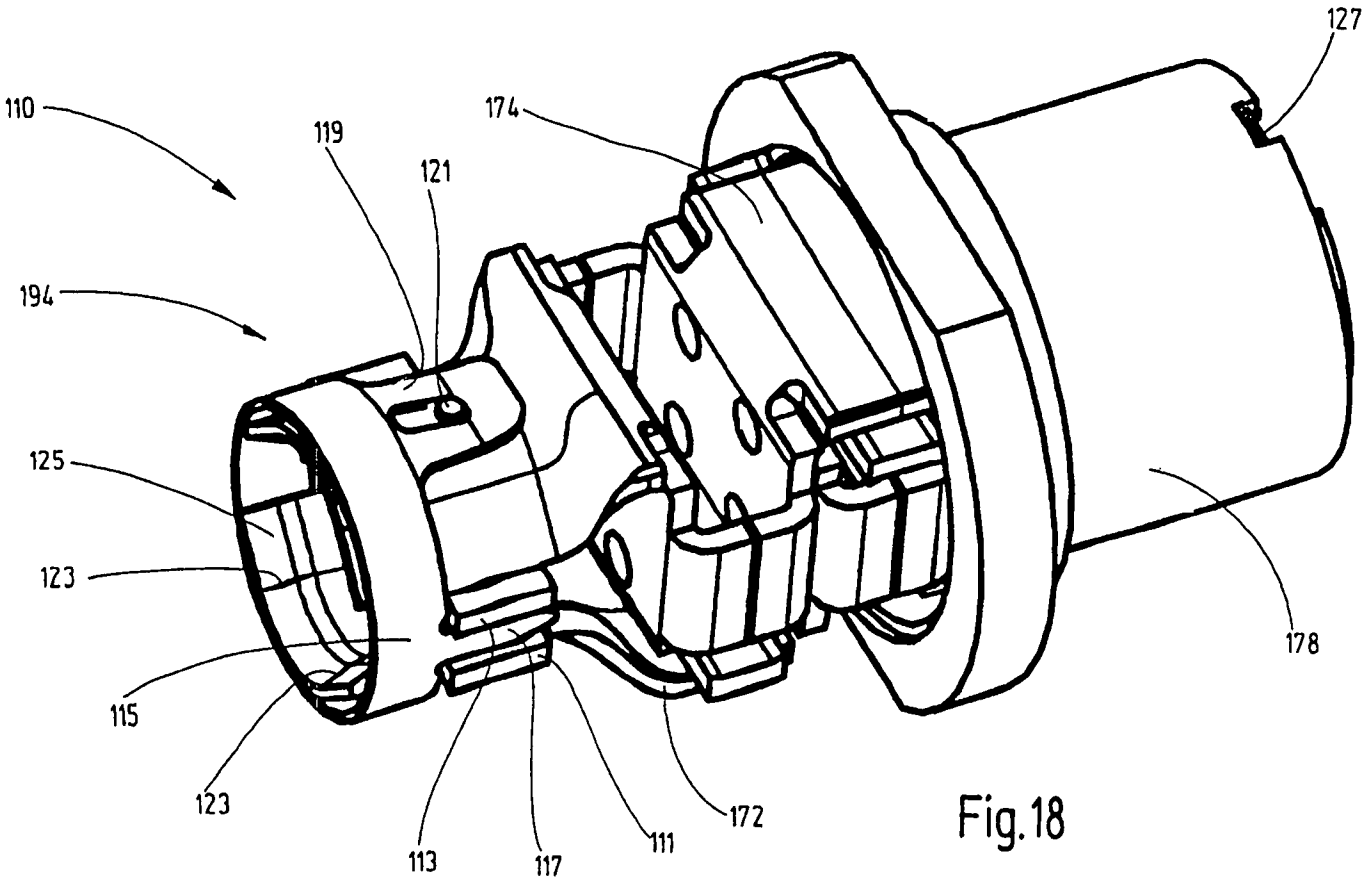
FIG. 18 is a perspective view of a second exemplary embodiment of a plug-in connector element for the plug-in connector system of FIG. 1.

FIG. 8 shows an extract of a section through the housing 48 of the first plug-in connector part 2 in a region in which the electrical line 6 shown in a front view is connected to the first plug-in connector part 2. The line 6 is a cable with an inner conductor 53 surrounded by insulation 55 onto which a metallically conductive cable shield 57 is applied outside. On its end, hidden by a sleeve-shaped connecting element 78, the inner conductor 53 is electrically and mechanically connected to an electrical plug-in connector element 10 described below (FIGS. 17, 18).

The plug-in connector part 2, which is a device 11 for electrically connecting the cable shield 57 of the electric line 6 to the housing 48, has a fixing element 81, 85, 87 with three parts in this exemplary embodiment. By these three parts, the connecting element 78, and thus, the inner conductor 53 are immovably fixed in the housing 48 by positive engagement when a tensile force arises on the line 6. The connecting element 78 is sleeve-shaped at least in sections and is mechanically tightly connected to the inner conductor 53, especially pressed to the inner conductor 53. Pressing takes place with interposition of two contact plates 72, 74 which also integrally form the contact element of the plug-in connector element 10.

The connecting element 78 on at least one end has a flange-shaped widening 84 forming a contact surface 79 for a first part 81 of the fixing element, which surface is preferably circularly ring-shaped and forms a positive engagement in the direction of the tensile force. The first part 81 of the fixing element is sleeve-shaped, surrounds the connecting element 78, and extends in the direction to an end oriented away from the contact element of the plug-in connector element 10 beyond the connecting element 78. On its face-side end, the first part 81 of the fixing element is in contact with a second part 85 of the fixing element which is likewise made sleeve-shaped and accommodates the line 6 in itself, with the interposition of a connecting lead 83 extending radially to the outside for the cable shield 57. On its end opposite the first part 81, the second part 85 has a contact surface for a third part 87 of the fixing element which in the direction of the tensile force forms a positive engagement with the housing 48.

The third part 87 of the fixing element in the exemplary embodiment is made clip-shaped, with the pertinent clips being insertable into an opening 89 (FIG. 1) intended for this purpose in the housing 48 in a direction obliquely and especially transversely to the plug-in direction or to the longitudinal direction of the line 6 to lock the fixing element in the housing 48. When a tensile force arises on the cable 6, this tensile force is transferred via the inner conductor 53 to the connecting element 78 in positive contact with the first part 81 of the fixing element; the first part 81 in turn is in positive contact with the second part 85; and the second part 85 is in turn is in positive contact with the third part 87. The third part 87 is in positive contact with the housing 48. In this way, a tight connection between the line 6 and the housing 48 is made available based solely on positive contact and independent of friction forces.

The device 11 is a component of a receiving chamber assigned to each pole for one load contact 12, 14, 16, 212, 214 at a time in each embodiment of the housing 48 of the first plug-in connector part 2. The device 11 can be made identically both for straight plug-in connectors and for right angle plug-in connectors, except for the execution of the contact elements.

The device 11 has an intermediate element 91 which can be made of a plastic. The intermediate element 91 can also be referred to as an insulating sleeve. The intermediate element 91 encompasses the connecting element 78 at least in sections and projects beyond the connecting element 78 in the direction to the contact element of the plug-in connector element 10. In the illustrated exemplary embodiment, the intermediate element 91 integrally forms a sleeve-shaped guide portion 75 which, when the first and second plug-in connector parts 2, 4 are mated, comes into contact with the sleeve-shaped portion 32 (FIG. 1) of the second plug-in connector part 4 and is guided.

The device 11 has a spring element 93 with which the connecting element 78 in the housing 48 is preloaded in the direction to the positive engagement with the fixing element; in the exemplary embodiment, connecting element 78 is preloaded in the direction to the first part 81 of the fixing element. The spring element 93 is, on the one hand, in contact with a shoulder of the intermediate element 91, which shoulder projects radially to the outside; and, on the other hand, is in contact with a shoulder of the housing 48 which projects radially to the inside. A stop ensures that the spring element 93 can be pressurized only up to a definable value, for example, up to 30% compression.

In a portion between the positive contact with the connecting element 78 and the positive contact with the second part 85 and the connecting lead 83 for a cable shield 57, the first part 81 of the fixing element has a latch 95 with which the first part 81 can be locked to the intermediate element 91 when the device 11 is being mounted. In the exemplary embodiment, the latch 95 is formed by a portion of larger radial dimension which can engage a correspondingly shaped recess in the intermediate element 91 by latching. On its end oriented away from the contact element of the plug-in connector element 10, the intermediate element 91 can have a slotted portion, and on the end thereof a starting bevel 97 can be provided for locking in of the first part 81.

On its end oriented away from the contact element of the plug-in connector 10, the second part 85 of the fixing element projects beyond the end of the housing 48, as a result of which the electric line 6 is guided. On the inside near this axial end between the second part 85 and the line 6, a sealing element 99 in the axial direction forms several sealing surfaces. In the exemplary embodiment sealing element 99 has the cross-sectional shape of a corrugated tube. The sealing element 99 also ensures guidance of the line 6 in the housing 48. In the region of the sealing element 99, radially to the outside, the third part 87 of the fixing element is in contact with the inner surface of the housing 48 by another sealing element 77. The third part 87 can also be referred to as an interlock.

Figure 9:
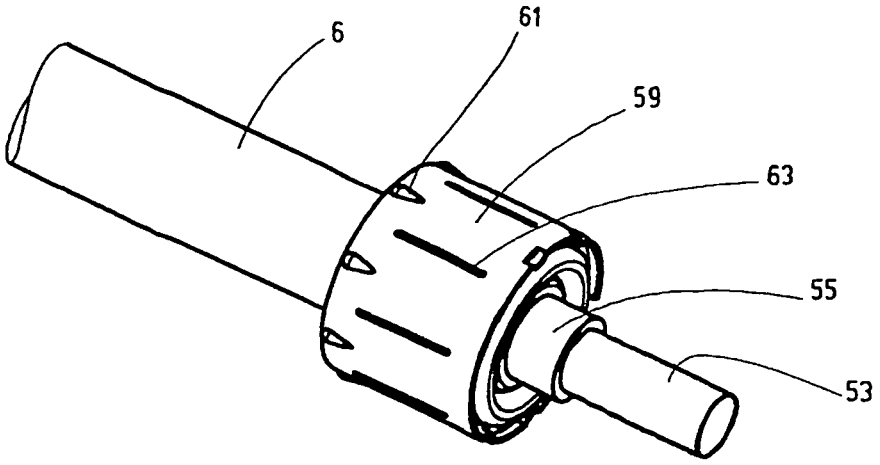
FIG. 9 is a perspective view of one section of the line with the insulation stripped on the conductor end of the plug-in connector system of FIG. 1.

FIG. 9 shows a perspective view of a portion of the line 6 with the insulation 55 stripped from the conductor end to expose the inner conductor 53. In the region of the insulation 55, a substantially ring-shaped shielding element 59 makes electrical contact with the cable shield 57 (FIG. 8). The shielding element 59 can be formed from a flat sheet metal part produced by punching. In the formed state, shielding element 59 has a ring-shaped portion that can be brought into contact with the line 6 to be connected. Moreover, the shielding element 59 in the peripheral direction has radially projecting contact tongues 61, preferably uniformly distributed. Tongues 61 can be brought into contact with the housing 48 and, in this way, make electrical contact with the housing 48. The shielding element 59 has slots 63 extending in the direction of the inner conductor 53, preferably uniformly distributed in the peripheral direction and reducing the eddy currents occurring in the shielding element 59.

Figure 10:
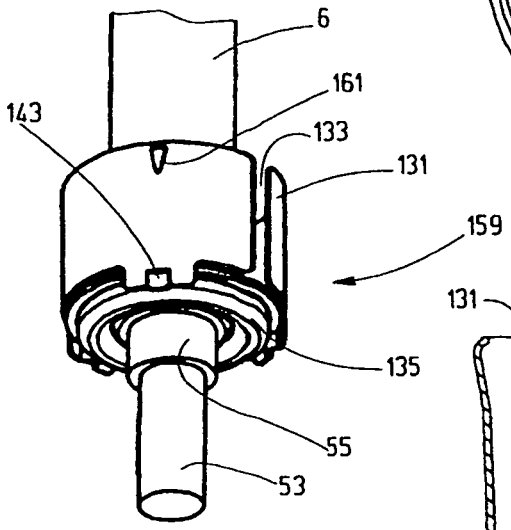
FIG. 10 is a perspective view of one section of the line with an alternative embodiment of a shielding element.
Figure 11:
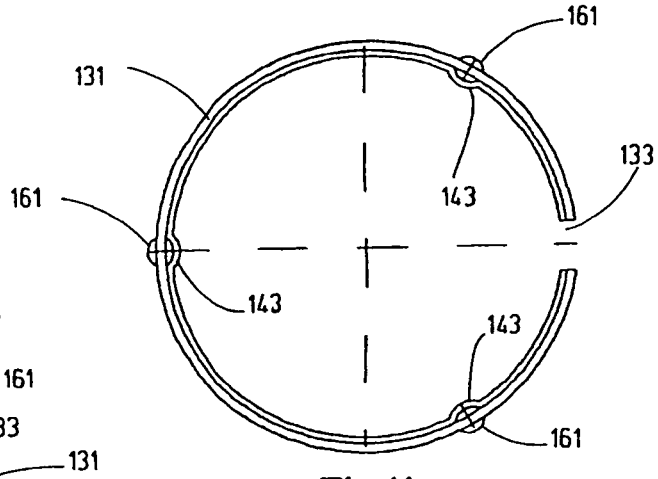
FIG. 11 is a top plan view of the first part of the shielding element of FIG. 10.
Figure 12:
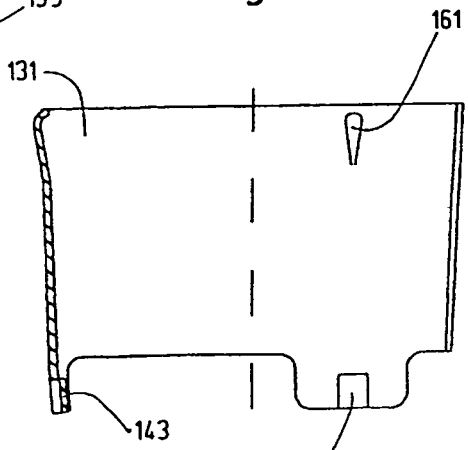
FIG. 12 is a side elevational view in section of the first part of the shielding element of FIG. 10.
Figure 13:
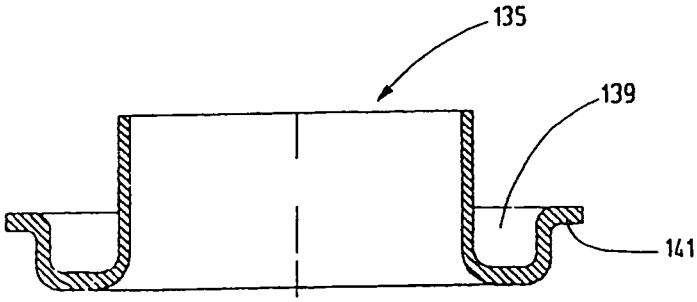
FIG. 13 is a side elevational view in section through a second part of the shielding element of FIG. 10.

FIG. 10 shows a perspective view of one portion of the line 6 with an alternative embodiment of a shielding element 159 made in several parts. A first part 131 of the shielding element 159 can be made as a punched/bent part and can have a continuous axial slot 133 by which the first part 131 can be elastically deformed. The first part 131 can also be referred to as a shielding contact. FIG. 11 shows a top view of the first part 131. FIG. 12 shows a side view of a section through the first part 131. The first part 131 forms a contact element for the cable shield 57 of the line 6. FIG. 13 shows a section through a second part 135 of the shielding element 159 with which the cable shield 57 can make electrical contact and in particular can establish an electrically conductive connection between the cable shield 57 and the first part 131. The second part 135 can also be referred to as a shield crimp.

Figure 14:
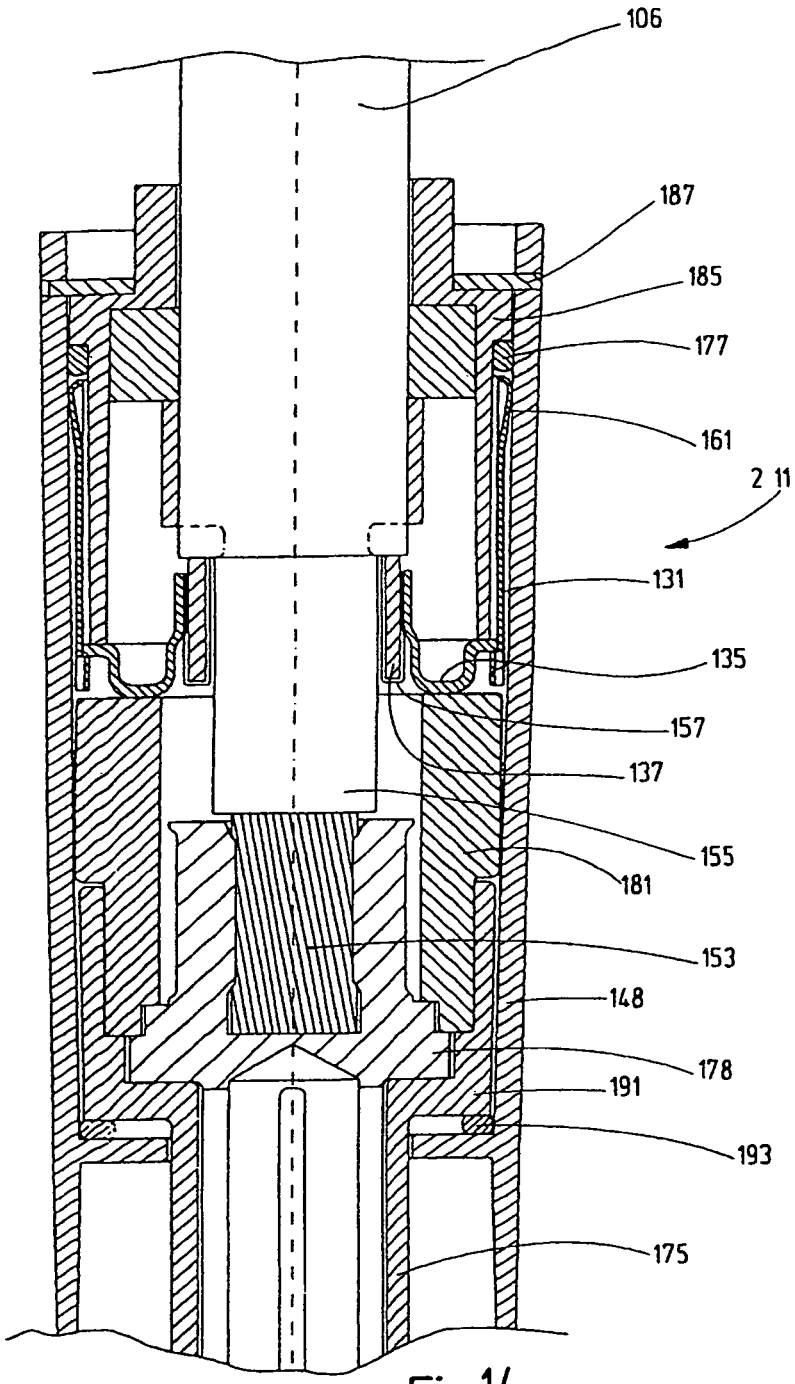
FIG. 14 is a partial side elevational view in section through a second exemplary embodiment of a housing of the first plug-in connector part.

FIG. 14 shows an extract of a section through a second exemplary embodiment of a housing 148 of the first plug-in connector part 2. To the extent that corresponding features are designated the same way as in the exemplary embodiment of FIG. 8, reference numbers are used increased by 100 relative to the reference numbers used in FIG. 8. In the exemplary embodiment of FIG. 14, a shielding element 159 is used as is shown in FIGS. 10 to 13. The shielding element 159 encompasses a third part 137 with which the cable shield 157 of the line 106 is mechanically fixed, especially crimped. The third part 137 can also be referred to as a support crimp. The third part 137 tightly surrounds both the cable shield 157 on the insulation 155 and also the outer cable jacket of the line 106. The portion of the third part 137 surrounding the insulation 155 and the cable shield 157 is spaced axially apart from the portion of the third part 137 surrounding the outer cable jacket. The exemplary embodiment of the housing 148 of FIG. 14, like the exemplary embodiment of FIG. 8, is cone-shaped inside. In contrast to FIG. 8, in the housing 148 of FIG. 14, the outside shape is also conical since the wall thickness is roughly the same.

The projecting end of the cable shield 157, which has been shortened to a suitable length, is turned up over the portion surrounding the insulation 155 and the cable shield 157 and is surrounded by the second part 135 of the shielding element 159. The second part 135 is shaped such that its outer edge extends almost to the inner surface of the housing 148. To stiffen the face-side end of the second part 135, the end has a stiffener 139 which in the exemplary embodiment is formed by a ring-shaped depression. On the outside, the second part 135 has a preferably peripherally extending edge portion 141 extending at a right angle to the longitudinal axis, In the exemplary embodiment, edge portion 141 is set back from the axial ends of the second part 135, with the distance to the one axial end being less than to the opposite, other axial end.

On the outer edge, the second part 185 of the fixing element is positively supported in the axial direction. The second part 185 can also be referred to as a sealing sleeve. On the face-side end of the second part 135 of the shielding element 159, the first part 181 of the fixing element is positively supported in the axial direction, with the support of the first part 181 lying radially inside compared to the support of the second part 185 of the fixing element. The first part 181 can also be referred to as a spacer sleeve. In the exemplary embodiment, the second part 135 is rotationally symmetrical to its longitudinal axis. By turning up the cable shield 157, it has a defined distance from the main contact.

Between the edge portion 141 of the second part 135 and the housing 148 is the first part 131 of the shielding element 159. In the exemplary embodiment, it has a slotted sleeve which in the undeformed state has a shape that is non-cylindrical, and is especially conical. On or near one axial end, the first part 131 on its outer surface has contact tongues 161 or contact lugs with which electrical contact can be made with the housing 148. The tongues or lugs 161 are preferably uniformly distributed in the peripheral direction and are formed in one piece by embossing. On or near the opposite end, the first part 131 on its inside has second contact tongues 143 or contact lugs with which electrical contact can be made with the second part 135 of the shielding element 159. The second tongues or lugs 143 are arranged preferably uniformly distributed in the peripheral direction and are formed in one piece by embossing.

In the installed state shown in FIG. 14, the first part 131 is formed roughly into a cylindrical shape, since the cable of the line 106 with the parts mounted thereon is pushed into the housing 148 when it is being mounted. Due to the reset force of the first part 131, the first part 131 is in reliable electrical contact, on the one hand, with the inner surface of the housing 148 and, on the other hand, with the second part 135 of the shielding element 159. On the end of the first part 131, a stop is made preferably in one piece for contact with the second part 135, especially for contact with the edge portion 141 of the second part 135 to ensure that the first part 131 is axially in a defined position in the housing 148, especially in a defined position relative to the second part 135 and thus relative to the line 106. The stop can be formed by the second contact tongues 143.

The arrangement of the three contact tongues 161 at a time or three second contact tongues 143 ensures a defined contact of the first part 131 both radially to the outside with the housing 148 and also radially to the inside. For each radially outer contact tongue 161, there is one radially inner second contact tongue 143. The connecting line extending between contact tongues 161, 143 assigned to one another parallel to the longitudinal axis of the line 106 ensure a corresponding current flow direction for the cable shield current. The short distance between the sleeve-shaped first part 131 and the housing 148 ensures good capacitive coupling of the shielding contact.

The outside diameter of the second part 135 in the region of the edge portion 141 is only slightly less than the inside width of the housing 148 minus the thickness of the first part 131. In this region play of less than 2 mm, especially less than 1.2 mm, and preferably less than 0.8 mm is provided. In the exemplary embodiment, the distance is roughly 0.5 mm. When there is a radial movement of the line 106, especially of the cable with the parts attached to it, i.e., also with the second part 135, the first part 131 moves at that axial position at which the first part 131 makes electrical contact with the second part 135, likewise, where the movement experiences a stop when the first part 131 makes contact with the inside of the housing 148.

On its opposite end, the first part 131 conversely does not move in the radial direction, since the first part 131 is centered by the contact of the contact tongues 161 within the housing 148. In this way, the first part 131 is pivoted. This arrangement has the advantage that in this way relative movement takes place at the contact site, as a result of which the contact surfaces are cleaned. The end portion of the first part 131, with which the first part 131 is connected to the second part 135, is bent to the inside relative to the bordering portion by an angle of more than 0.2° and less than 6°, especially more than 0.5° and less than 4°, and preferably more than 0.5° and less than 2.5°, so that this end portion does not experience bending stress during a pivoting motion of the first part 131. This stress would be disadvantageous should vibrations occur. The length of the bent portion is less than 30% of the length of the first part 131, especially less than 20%, and preferably less than 15%. In the exemplary embodiment, the length of the bent portion is equal to the length of the second contact tongues 143+/−25%.

Figure 15:
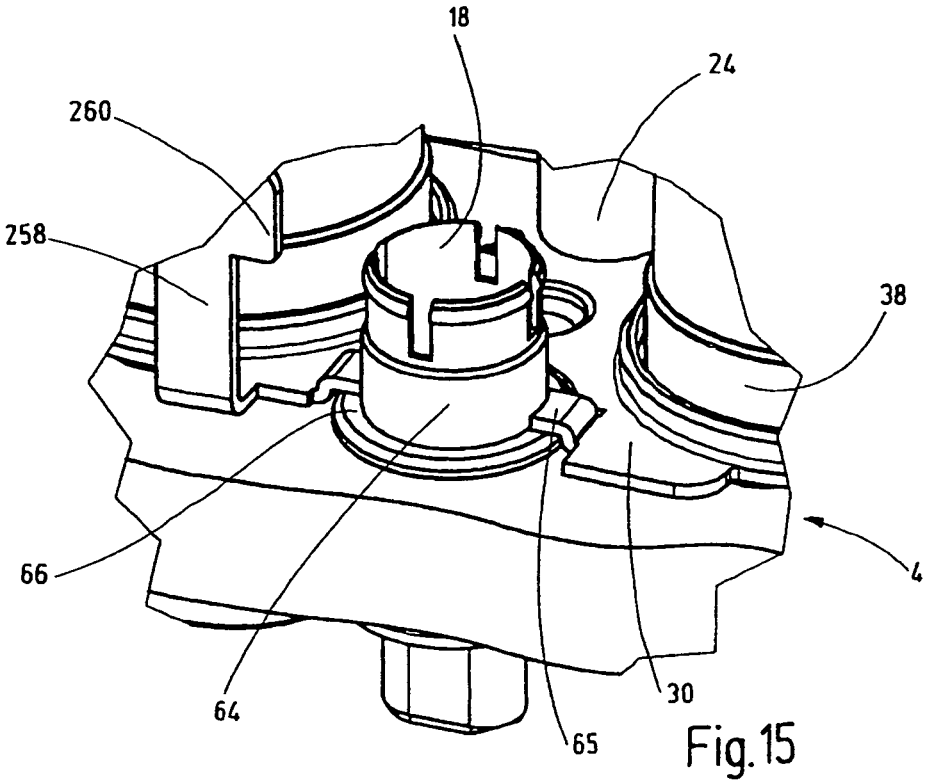
FIG. 15 is a partial perspective view of the second plug-in connector part in the region of the pilot contact of the plug-in connector system of FIG. 3.

FIG. 15 shows a perspective view of an extract of the second plug-in connector part 4 in the region of the pilot contact 18. On its end facing the terminal strip 30, an electrically conductive, loosely attached sleeve-shaped portion 64 on the plug-in unit for the pilot contact 18 has a flange-shaped widening. A contact lug 65, formed preferably in one piece from the terminal strip 30, can be brought into contact-making contact with widening 66. The contact lug 65 can be deflected elastically relative to the terminal strip 30, fixes the sleeve-shaped portion 64 to the housing wall 8, and ensures shield linkage. In one embodiment, the contact lugs 65 are press pads for the conductive sleeve bent down on the end with flange-shaped widening 66 placing the shield linkage at the potential of the generating set.

Figure 16:
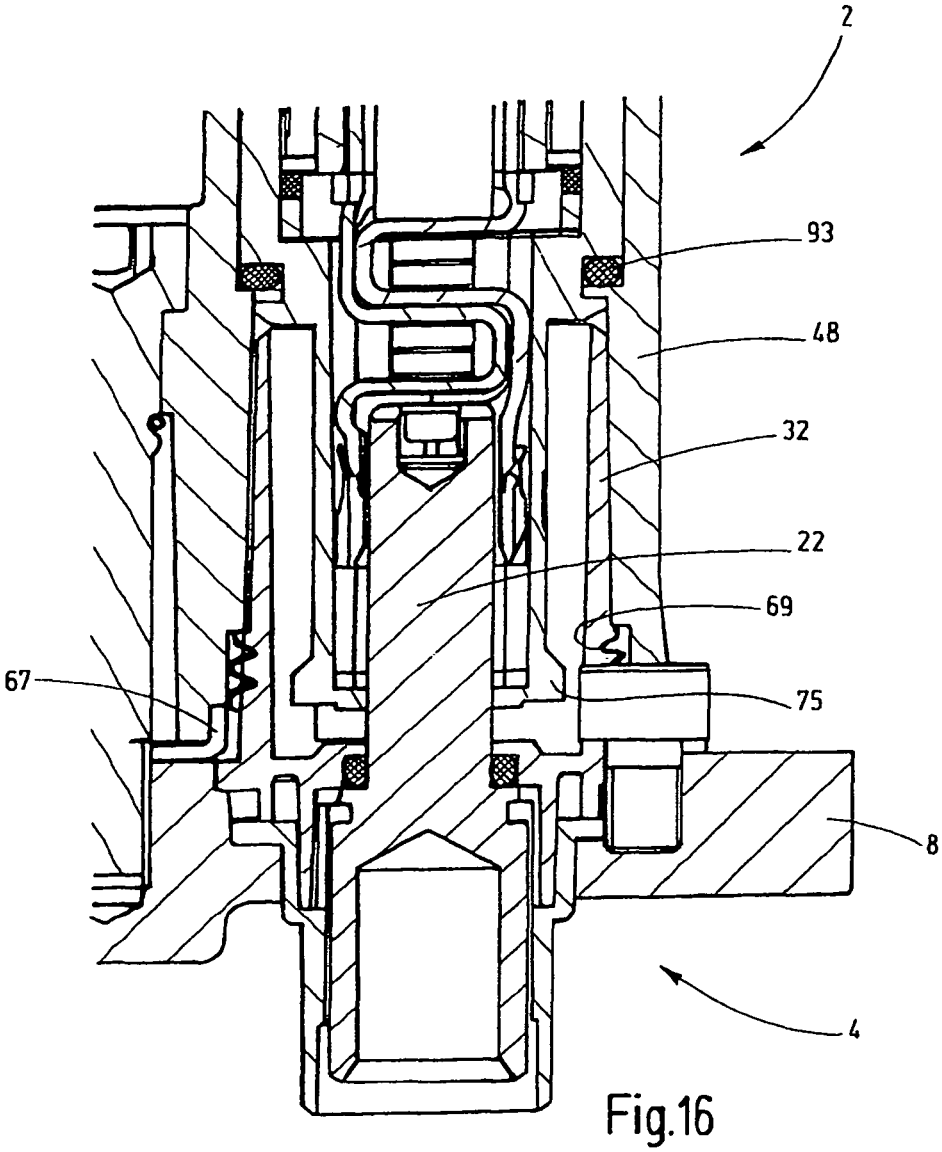
FIG. 16 is a partial side elevational view in section through the housing of the first plug-in connector part.

FIG. 16 shows an extract of a section through the housing 48 of the first plug-in connector part 2 and the housing wall 8 of the generating set with the second plug-in connector part 4 in the mated state. Between the sleeve-shaped portion 32 of the second plug-in connector part 4 and the housing 48 of the first plug-in connector part 2, a seal 69 is provided, especially in contact with the ring-shaped portion 38 (FIG. 1) of the sleeve-shaped portion 32 on the one hand and the housing 48 on the other. The guide portion 75 of the first plug-in connector part 2, in the direction to the second plug-in connector part 4, is beyond the contact elements of the first plug-in connector part 2, so that they are located shockproof in the first plug-in connector part 2. A dome 67, formed preferably in one piece by the terminal strip 30, is in contact-making contact with the housing 48 of the first plug-in connector part 2. In one embodiment, the terminal strip 30 in the region of the passage of the load contacts 12, 14, 16 thus forms a positive counterhold for the housing 48.

FIG. 17 shows a perspective view of a first exemplary embodiment of a plug-in connector element 10 for use in the above-described first plug-in connector part 2. The plug-in connector element 10 has two contact plates 72, 74 formed by shaped, electrically conductive sheet metal strips. Each plate 72, 74 has a connecting portion 76, which in FIG. 17 is hidden by the sleeve-shaped connecting element 78, for electrically connecting the plug-in connector element 10 to the electric line 6. Furthermore, the contact plates 72, 74 have a contact portion 82 for a detachable electrical connection of the plug-in connector element 10 to a contact element of the second plug-in connector part 4. Furthermore, the contact plates 72, 74 have a compensating portion 80 located between the connecting portion 76 and the contact portion 82 for elastically deflecting the contact portion 82 relative to the connecting portion 76.

In the region of the connecting portion 76, the two contact plates 72, 74 are bent into the shape of a partial circle, especially roughly into a semicircle, and are fixed in the illustrated position by the sleeve 78. The connecting element 78, on its end facing the contact portion 82, has a support element 84 formed by a flange-shaped widening. By the support element 84, the connecting element 78 can be supported on an opposite element. As described above, thus the connecting element and the line 6 can then be fixed by positive engagement in the housing 48 of the first plug-in connector element 2 when a tensile force arises. Tensile forces or, for example, vibrations are then not relayed to the contact portion 82, as a result of which the electrical connection is especially reliable.

The line 6 to be connected to and to be inserted in the connecting portion 76 is stably and reliably connected to the plug-in connector element 10 by crimping of the sleeve 78, especially by the molding-on of a hexagon. The support element 84 causes the forces and/or deformations occurring during crimping to be kept away from the compensating portion 80. For this purpose, it is especially advantageous if another first widening portion 73 is placed ahead of the support element 84, so that the connector element 78 has a two-stage or also multistage widening.

In the compensating portion 80, the two contact plates 72, 74 are each bent in a meander shape, where, proceeding from the connecting portion 76, first the first contact plate 72 forms one U-shaped loop and then in the axial direction the second contact plate 74 forms a substantially equally dimensioned U-shaped loop. Then, the two contact plates 72, 74 extend further into the contact portion 82. On the bending sites of the meandering loops, the two contact plates 72, 74 each have at least one recess 86 by which the strip width of the contact plate 72, 74 is reduced and thus the bending stiffness is reduced. In the two parallel legs 88 of the meandering loop, the two contact plates 72, 74 have tool engagement surfaces 90 which in the exemplary embodiment are formed by holes by which the contact plates 72, 74 can be fixed when the loops are bent. Alternatively or in addition, holes can be formed in the contact plates for reducing bending stiffness. Moreover, the contact plates 72, 74 in the region of the legs 88 extending parallel have stops 92 which in the exemplary embodiment are formed by lugs which are bent by 90° and which are formed in one piece by the contact plates 72, 74.

In the contact portion 82, the two contact plates 72, 74 are bent in a V-shape and include an angle of between 60° and 150°, and preferably between 75° and 120°. Alternatively to the V-shape, the contact plates 72, 74 have a bent shape deviating from the cross-sectional contour of the contact element of the second plug-in connector part 4, so that one or preferably two line contacts per contact plate 72, 74 are created. A separate spring 94 is seated on the contact plates 72, 74 bent in this way, and with it the contact plates 72, 74 can be kept in contact-making contact with the contact element of the assigned second plug-in connector part 4. The separate spring 94 has a ring-shaped portion 96 which limits the maximum widening of the contact plates 72, 74 in the contact portion 82. Spring arms 98 project in the axial direction from the ring-shaped portion 96; in the undeformed state they are bent to the inside and apply the contact force. In the exemplary embodiment, there are two spring arms 98 on opposite sides.

Offset by 90° at a time to the spring arms 98, the separate spring 94 has guides 68 bent on or near its free end radially to the inside and engage a gap formed between the two contact plates 72, 74. In this way, the guides 68 guide the separate spring 94 when clipped onto the contact portion 82. At the transition from the contact portion 82 to the compensating portion 80, the two contact plates 72, 74 form a stop 70 for slipping on the separate spring 94 by a radial widening.

FIG. 18 shows a perspective view of a second exemplary embodiment of a plug-in connector element 110 for use in the above-described first plug-in connector part 2. In the contact portion, the first and the second contact plates 172, 174 have lugs 111, 113 projecting to the outside and jointly forming a guide and a stop for clipping on the separate spring 194. The ring-shaped portion 115 of the separate spring 194 is located on one end facing the second plug-in connector part 4. From the ring-shaped portion 115, on opposite sides, guides 117 project and are inserted between the two lugs 111, 113 when the separate spring 194 is clipped on. The guides 117 have a rounded or beveled end portion. The guides 117 alternatively or additionally form spacers preventing the two contact plates 172, 174 from being pressed together to an excessive degree.

Latches 119 project from the ring-shaped portion 115 on opposite sides and interact with corresponding latches 121 of the contact plates 172, 174. In the exemplary embodiment, the latches 119 of the separate spring 194 have openings or depressions that are engaged by the latches 121 formed, for example, in one piece by embossing from the contact plates 172, 174, for example, a nub.

On the end side, the ring-shaped portion 115 ends substantially flush with the contact plates 172, 174. The contact plates 172, 174, on the end side, form an insertion bevel 125 for the contact pin 22 (FIG. 1). Each of the contact plates 172, 174, due to its shape, has two line contacts 123 for the contact-making contact with the contact pin 22.

In the region of the connecting portion, especially on its connecting portion-side end, the connecting element 178 has an adjustment device 127 by which the position of the connecting element can be set with reference to the contact plates 172, 174. The adjustment device 127 can be formed by a recess into which, right after the contact plates 172, 174 are inserted, a corresponding positioning is impressed. The connecting element 178 then is kept only in one definable angular position on the contact plates 172, 174 and is protected against rotation during further mounting.

Figure 19:
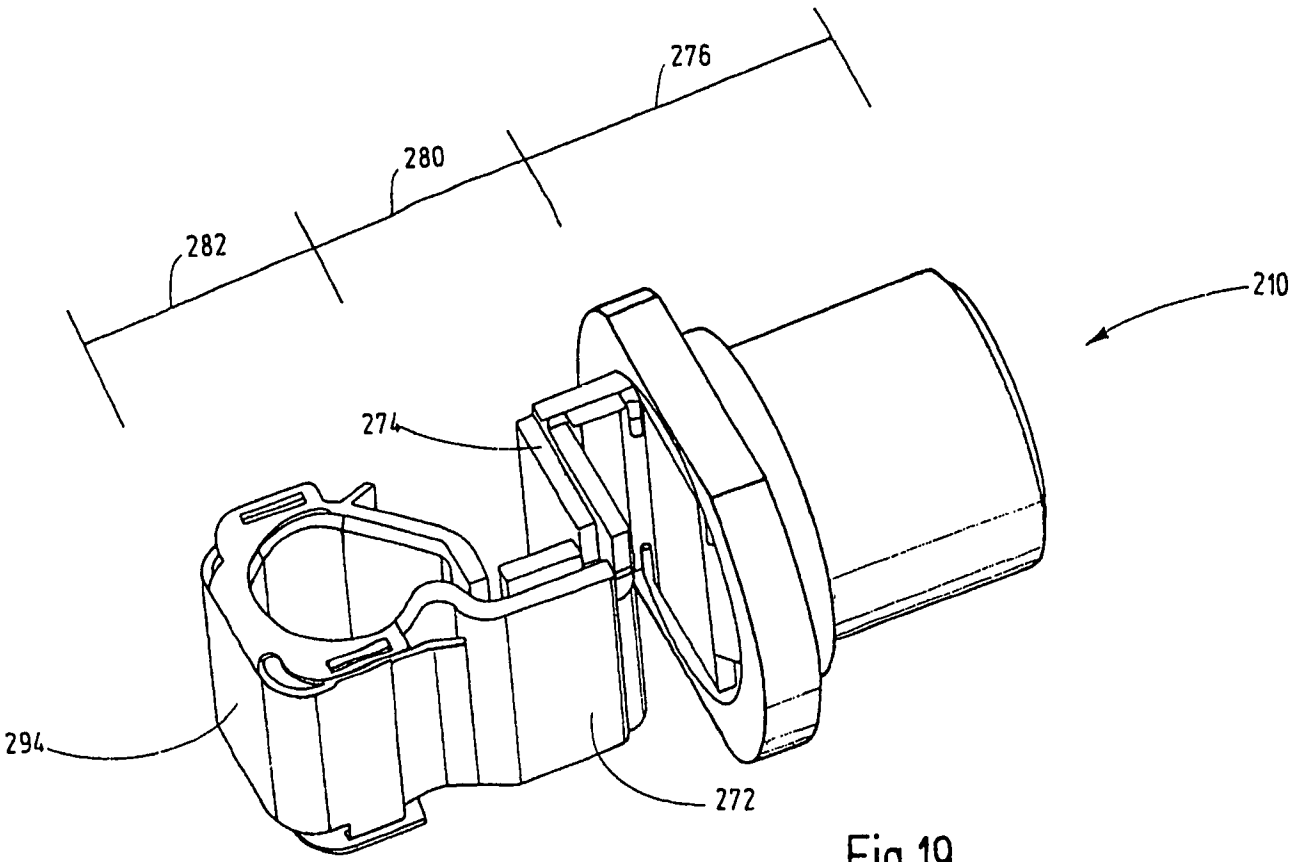
FIG. 19 is a perspective view of an exemplary embodiment of a plug-in connector element for a right angle plug.

FIG. 19 shows one exemplary embodiment of a plug-in connector element 210 for a right angle plug. In contrast to the plug-in connector element 10 of FIG. 17, one of the contact plates 274 is simply bent at a right angle and need not form a complete meander loop. The contact pin 22 (FIG. 1) is inserted transversely to the longitudinal direction of the plug-in connector element 210, defined by the successive arrangement of connecting portion 276, compensating portion 280, and contact portion 282. The separate spring 294 is produced as a punch/bent part and is seated on the contact portion 282.

Figure 20:
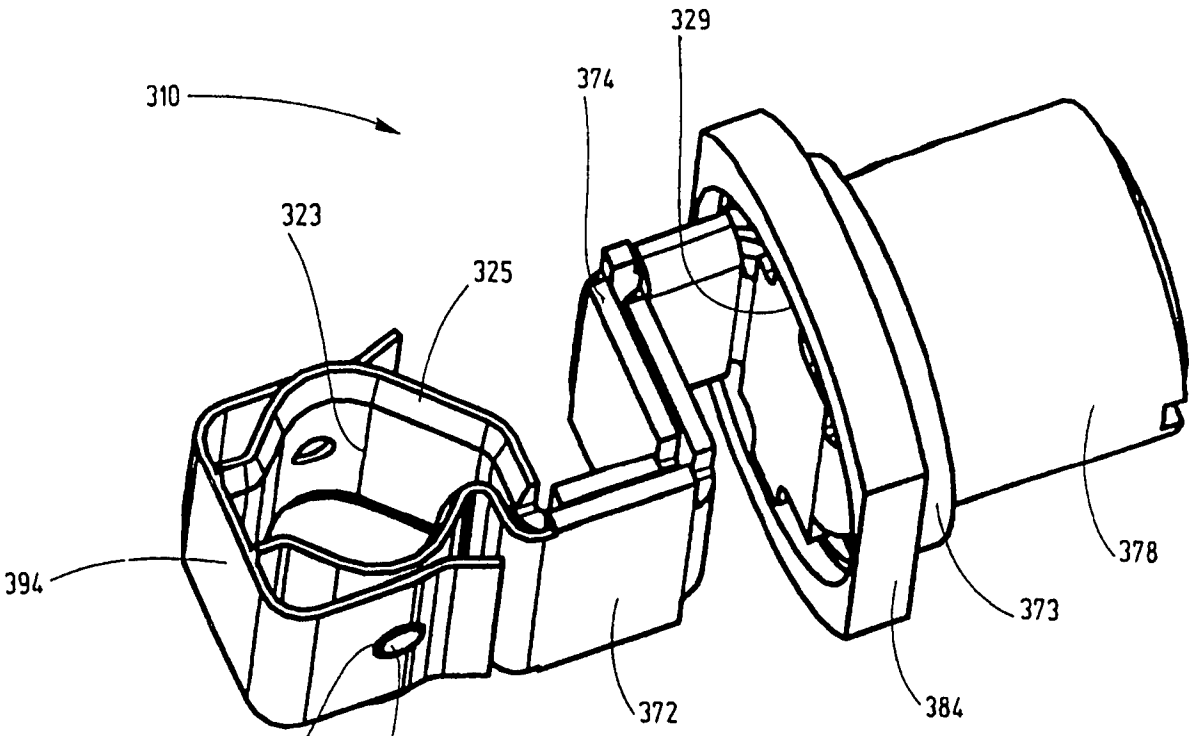
FIG. 20 is a perspective view of another exemplary embodiment of a plug-in connector element for a right angle plug.

FIG. 20 shows another exemplary embodiment of a plug-in connector element 310 for a right angle plug. The separate spring 394 has two legs with at least one latch 319, each interacting with corresponding latches 321 of the contact plates 372, 374. In the exemplary embodiment, the latches 319 of the separate spring 394 each have an opening or depression engaged by the latches 321, which are made, for example, by embossing in one piece from the contact plates 372, 374, by latching.

On the end side, the contact plates 372, 374 form an insertion bevel 325 for the contact pin 22 of the second plug-in connector part 4. Each of the contact plates 372, 374, due to its shape, has two line contacts 323 for the contact-making contact with the contact pin 22.

At least one of the contact plates 372, 374 has a stop 329 made preferably in one piece by which the contact plates 372, 374 can be inserted in the connector element 378 only up to a corresponding stop. The corresponding stop can be formed by the transition from the support element 384 to the first widened portion 373 on the inside of the connecting element 378.

For all illustrated plug-in connector elements, a reliable electrical connection is made available by providing a total of four line electrical contacts. The separate springs 94, 194, 294, 394 ensure a nonpositive contact with the corresponding contact element of the assigned second plug-in connector part 4. The compensating portion 80, 280 ensures reliable contact between the contact portion 82, 282 and all four contact lines. In particular, compensation of a parallel offset or of a tilted position of the contact element with which contact is to be made is ensured. The high current carrying capacity is made available by the direct contact of the contact plates 72, 74 which have a large cross-sectional area with the contact pin 22. The required flexibility of the contact plates 72, 74 is made available by the compensating portion 80, 280 made separately from the contact site and the connection to the line 6.

While various embodiments have been chosen to illustrate the invention, it will be understood by those skilled in the art that various changes and modifications can be made therein without departing from the scope of the invention as defined in the appended claims.

What is claimed is:

1. A device for electrically connecting a cable, comprising:

a plug-in connector part having a housing; and a shielding element in said housing and electrically contacting a cable shield on a cable to connect electrically the cable shield to said housing, said shielding element including a first part electrically connecting and contacting said housing and a second part electrically conductively connected to said first part, said first part being substantially sleeve-shaped and being elastically deformable in a peripheral direction thereof.

2. A device according to claim 1 wherein said first part has a continuous slot therein extending in a longitudinal direction thereof.

3. A device according to claim 1 wherein said first part has at least one outer contact on an outer side thereof kept in electrically connecting contact with said housing by elastic deformation of said first part.

4. A device according to claim 1 wherein said first part has at least one inner contact on an inner side thereof kept in electrically connecting contact with said second part.

5. A device according to claim 1 wherein said second part electrically conductively connects said first part to the cable shield, said second part having a sleeve-shaped portion being crimpable onto the cable shield.

6. A device according to claim 5 wherein said second part comprises an edge portion projecting radially relative to a longitudinal axis of said second part by which said second part is movable into electrically connecting contact with said first part.

7. A device according to claim 1 wherein said shielding element comprises a third part having a first sleeve-shaped portion with an inner side surrounding insulation and the cable shield on the insulation of the cable.

8. A device according to claim 7 wherein said second post is applied to an outer side of a first sleeve-shaped portion of said third part, with imposition of the cable shield being folded down and around a free end of said first sleeve-shaped portion to provide electrical contact therebetween.

9. A device according to claim 7 wherein said third part comprises a second sleeve-shaped portion surrounding a jacket of the cable.

10. A device according to claim 1 wherein a connector element is located in said housing and is connectable to an inner conductor of the cable by a mechanically strong connection, said shielding element transferring an axially directed force by said connector element to fix immovably the inner conductor in said housing by positive engagement to resist tensile forces.

11. A device for electrically connecting a cable, comprising:

a plug-in connector part having a housing; and a shielding element in said housing and electrically contacting a cable shield on a cable to connect electrically the cable shield to said housing, said shielding element including a first part electrically connecting and contacting said housing and a second part electrically conductively connected to said first part, said first part having at least one outer contact on an outer side thereof kept in electrically connecting contact with said housing by elastic deformation of said first part.

12. A device according to claim 11 wherein said first part has at least one inner contact on an inner side thereof kept in electrically connecting contact with said second part.

13. A device according to claim 11 wherein said second part electrically conductively connects said first part to the cable shield, said second part having a sleeve-shaped portion being crimpable onto the cable shield.

14. A device according to claim 13 wherein said second part comprises an edge portion projecting radially relative to a longitudinal axis of said second part by which said second part is movable into electrically connecting contact with said first part.

15. A device according to claim 11 wherein said shielding element comprises a third part having a first sleeve-shaped portion with an inner side surrounding insulation and the cable shield on the insulation of the cable.

16. A device for electrically connecting a cable, comprising:

a plug-in connector part having a housing; and a shielding element in said housing and electrically contacting a cable shield on a cable to connect electrically the cable shield to said housing, said shielding element including a first part electrically connecting and contacting said housing and a second part electrically conductively connected to said first part, said first part having at least one inner contact on an inner side thereof kept in electrically connecting contact with said second part.

17. A device according to claim 16 wherein said second part electrically conductively connects said first part to the cable shield, said second part having a sleeve-shaped portion being crimpable onto the cable shield.

18. A device according to claim 17 wherein said second part comprises an edge portion projecting radially relative to a longitudinal axis of said second part by which said second part is movable into electrically connecting contact with said first part.

19. A device according to claim 16 wherein said shielding element comprises a third part having a first sleeve-shaped portion with an inner side surrounding insulation and the cable shield on the insulation of the cable.

20. A device for electrically connecting a cable, comprising:

a plug-in connector part having a housing; and a shielding element in said housing and electrically contacting a cable shield on a cable to connect electrically the cable shield to said housing, said shielding element including a first part electrically connecting and contacting said housing and a second part electrically conductively connected to said first part, said second part electrically conductively connecting said first part to the cable shield, said second part having a sleeve-shaped portion being crimpable onto the cable shield.

21. A device according to claim 20 wherein said second part comprises an edge portion projecting radially relative to a longitudinal axis of said second part by which said second part is movable into electrically connecting contact with said first part.

22. A device according to claim 20 wherein said shielding element comprises a third part having a first sleeve-shaped portion with an inner side surrounding insulation and the cable shield on the insulation of the cable.

23. A device for electrically connecting a cable, comprising:

a plug-in connector part having a housing; and a shielding element in said housing and electrically contacting a cable shield on a cable to connect electrically the cable shield to said housing, said shielding element including a first part electrically connecting and contacting said housing, including a second part electrically conductively connected to said first part and including a third part having a first sleeve-shaped portion with an inner side surrounding insulation and the cable shield on the insulation of the cable.

* * * * *